United States Patent [19]

Distler et al.

[11] 4,180,757

[45] Dec. 25, 1979

[54] INCANDESCENT LAMP WITH VIBRATION-PROTECTED FILAMENT MOUNT

[75] Inventors: Jack E. Distler, Indianapolis, Ind.; Albert A. Hamilton, Belton, Mo.; Everett R. King, Fort Lauderdale, Fla.

[73] Assignees: Western Electric Co., Inc.; Bell Laboratories, Inc., both of New York, N.Y.

[21] Appl. No.: 880,392

[22] Filed: Feb. 23, 1978

[51] Int. Cl.[2] ..... H01K 1/14

[52] U.S. Cl. ..... 313/315; 313/269; 313/278; 313/333

[58] Field of Search ..... 313/269, 278, 333, 315

[56] References Cited

U.S. PATENT DOCUMENTS

| | | | |
|---|---|---|---|
| 353,333 | 11/1886 | Van Depoele | 313/333 |
| 2,315,504 | 4/1943 | Curtis | 313/333 X |
| 3,007,073 | 10/1961 | Swasey | 313/269 X |
| 3,375,393 | 3/1968 | Morgan | 313/269 |

*Primary Examiner*—Saxfield Chatmon, Jr.
*Attorney, Agent, or Firm*—W. O. Schellin

[57] ABSTRACT

An incandescent lamp has a coiled filament with an improved life when it is mounted substantially in the same direction in which a mechanical shock occurs. In a particular embodiment of a miniature lamp known as a switchboard lamp, the filament is mounted, without further support, between two posts. This results in a greater light effectiveness that permits a current reduction through the filament while maintaining desired light output levels in its operational environment. The filament is protected from harmful shock levels by being mounted between twisted posts which orient the filament in the general direction of a mechanical shock imparted to the lamp through key telephone button releases.

4 Claims, 4 Drawing Figures

INCANDESCENT LAMP WITH VIBRATION-PROTECTED FILAMENT MOUNT

FIELD OF THE INVENTION

This invention relates to incandescent lamps, and particularly to incandescent lamps operating in an environment subject to mechanical shock or vibration. This invention is described as an improvement to a miniature lamp which is known in the communicationsindustry as a switchboard lamp. However, the description of this specific embodiment is not intended to be limiting to the scope of the invention.

DESCRIPTION OF THE PRIOR ART

The lifetime of a filament in an incandescent lamp tends to be reduced when the lamp operates in an environment which is subject to mechanical shock and vibration. U.S. Pat. No. 3,375,393 to Morgan recognizes the problem of providing a simple yet rugged structure in a tubular, miniature lamp which can withstand extreme conditions of mechanical shock and vibration. The patent to Morgan discloses a filament in a miniature lamp which is supported by a plurality of intermediate filament support wires. The support wires rest against the inside of a glass envelope to absorb the greater portion of the shock transmitted to the lamp. It is, of course, desirable to simplify the support of the filament in such a miniature lamp, when this can be done without reducing the ruggedness of the lamp.

When a tungsten wire is used as a filament in a miniature lamp, the wire can be coiled over a mandrel to increase the length of a filament supported between two fixed posts. A prior art miniature lamp, which is also known as a switchboard lamp, supports such a coiled tungsten-rhenium wire between two posts and a single, intermediate support. The assembly of the lamp with the intermediate support is still cumbersome. Therefore, it is desirable to further simplify the mounting of the filament.

It was attempted to mount a coiled filament between two posts located adjacent two slide base terminals without an intermediate support. It was found that the lifetime of the lamp tested under environmental operatingconditions of a key telephone did not reach desired lifetimes of the switchboards lamps having the intermediate supports.

SUMMARY OF THE INVENTION

It has been found that harmful shocks which shorten the lifetimes of switchboard lamps in key telephone sets are directional. It has furthermore been found that the lifetime of switchboard lamps are affected by the direction in which the filament is oriented with respect to the shock to which the lamp is subjected.

According to the present invention an incandescent lamp comprises an envelope. A pair of terminals are mounted adjacent to one end and on opposite sides of the envelope. Each of the terminals is centered on a longitudinal plane through the envelope. Each of two posts electrically coupled to one of the terminals. The posts extend from the one end of the envelope in spaced relationship into the envelope. A filament spans a gap between the posts within the envelope. The posts are twisted to position the filament substantially perpendicular to the plane on which the terminals are centered, to thereby orient the filament into the direction from which a mechanical shock is expected when the lamp is mounted in its operating environment.

BRIEF DESCRIPTION OF THE DRAWING

Various features and advantages of this invention are believed to be better understood from the following detailed description when it is read in conjunction with the accompanying drawing in which.

DETAILED DESCRIPTION

Figure 1:
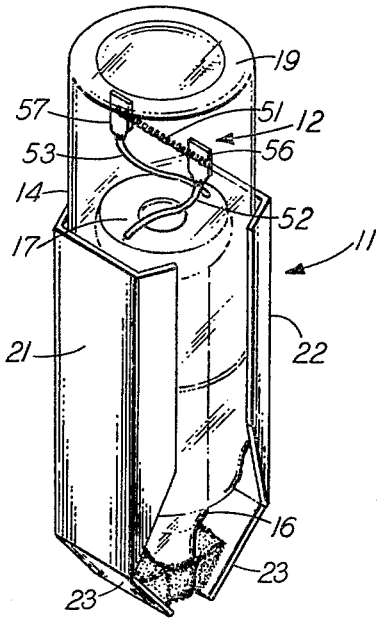
FIG. 1 is a pictorial view of a switchboard lamp having a filament mounted according to the present invention.

Referring to FIG. 1, a miniature lamp, designated generally by the numeral 11, is shown. The lamp 11 is of a type which is known in the communications industry as a switchboard lamp. An envelope 12 of the lamp 11 has a tubular or cylindrical center portion 14. One end 16 of the center portion 14 is sealed to an inserted glass stem 17. The other end of the center portion 14 terminates in a lens 19. The lens 19 is typically a substantially flat, circular glass end abutted to the center portion 14.

Two terminals 21 and 22 are located on opposite sides of the center portion 14. The terminals 21 and 22 (see also FIGS. 3 and 4) are located at the end 16 and extend from the end 16, after an initial taper in a guide 23, in parallel to each other along approximately half of the length of the center portion 14. The terminals 21 and 22 are centered on a plane 24 longitudinally passing through the lamp 11. The plane 24 including a longitudinal axis 26 through the lamp 11 (see FIG. 4), is shown as a centerline in FIG. 4. The guide 23 aids in sliding the lamp 11 into a socket; the lamp 11 is therefore at times referred to as a slide-base lamp.

Figure 3:
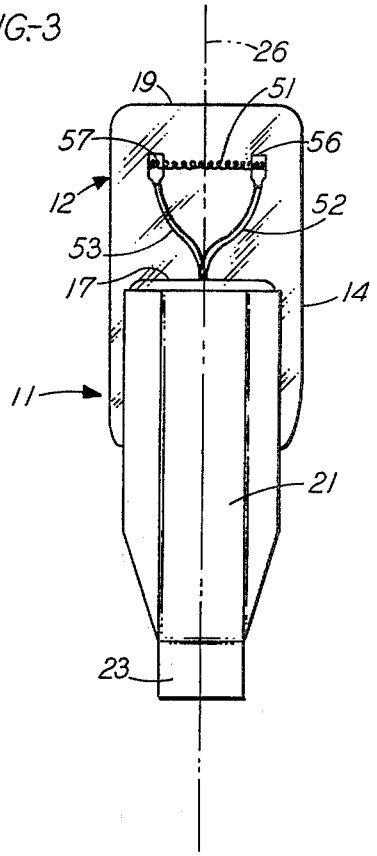
FIG. 3 is a side view of the switchboard lamp of FIG. 1.
Figure 4:
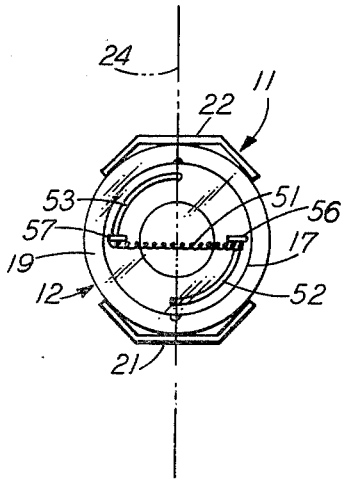
FIG. 4 is an end view of the switchboard lamp of FIGS. 1 and 3.

An advantageous use for the lamp 11 is in a key telephone 31 which accommodates several user line terminations in a single set. A portion of the key telephone 31 is shown in FIG. 3. With its cover removed, a lamp socket 32 is shown mounted on a bracket 33. In the key telephone 31 several of the sockets 32 are mounted adjacent to each other. Each socket 32 includes a pair of terminal contacts 34. Each of the contact 34 typically has two curved adjacent leaf spring portions 35 which are mounted to a horizontal mounting surface 36 of the bracket 33. The curved portions 35 of each contact 34 mutually face those of the other contact 34, centered on a horizontal plane parallel to the mounting surface 36. The lamp 11 is inserted into the socket 32 with its two outwardly facing terminals 21 and 22 making contact with the inwardly facing portions 35 of the contacts 34. In this orientation of the lamp 11 the plane 24 on which the terminals 21 and 22 are centered becomes located in a horizontal position.

The inserted lamp 11 is located adjacent to, and the lens 19 of the lamp 11 faces, a pushbutton assembly 41. In each pushbutton assembly 41 there are typically six similar pushbuttons 42 located in a row. With each of the pushbuttons 42 one of the lamps 11 becomes associated. Light from each lamp 11 illuminates its respective pushbutton 42 to indicate an activated user line terminating in the telephone 31.

The depression of one of the pushbuttons 42 is transmitted through an underlying plunger 43 of the assembly 41. The plunger 43 moves downward to perform an electrical switching operation. The depression of one of the pushbuttons 42 also causes another already depressed plunger 43 and pushbutton 42 of the assembly 41 to snap from its depressed position into a released or unoperated position. The release of a previously depressed plunger 43 and pushbutton 42 causes a shock to be transmitted to the bracket 33 and to the lamp 11. This shock which occurs each time when one of the pushbuttons 42 is released tends to have a deleterious effect on the lifetime of the lamp 11.

It has been found, however, that the shock transmitted to the lamp 11 is directional. Upon being released the plunger 43 accelerates upward under an urging force of a spring 44. The major shock component occurs when the released plunger 43 and the pushbuttom 42 associated therewith suddenly stop at the upper limit of their travel. The direction of the shock indicated by the arrow 45 is retained during the transmission of the shock waves from the assembly 41 through the bracket 33 to the lamp 11.

It has been found that the harmful effect of the shock on the lifetime of the lamp 11 is minimized, or even substantially eliminated, when a filament 51 in the lamp 11 is oriented substantially perpendicular to the plane 24. Such an orientation positions the filament 51 generally in the same direction as that in which the shock acts on the lamp 11. The filament 51 is mounted in the envelope 12 near the lens opening 19 between two posts 52 and 53. The posts 52 and 53 are physically mounted in the stem 17. Within the envelope, the posts 52 and 53 extend in spaced relationship toward the lens opening 19. The filament 51 is mounted to tips 56 and 57 of the posts 52 and 53.

The ends of the posts 52 and 53 opposite the tips 56 and 57 protrude from the end 16 to the outside of the envelope 12. Being folded over against the center portion 14, the protruding ends become sandwiched between the center portion 14 and a respective one of the terminals 21 and 22 to establish contact therewith. Proper contact with the folded ends (not shown) and the terminals 21 and 22 is insured by orienting the stem 17 to position the portions of the posts 52 and 53 located in the stem in the plane 24. Such an orientation centers the protruding ends of the posts 52 and 53 on the terminals 21 and 22 since the terminals themselves are also centered on the plane 24.

The orientation of the posts 52 and 53 in the stem 17, and their straight extensions toward the lens 19, would inherently bring about an orientation of the filament 51 in the plane 24. However, to avoid such an orientation of the filament 51, the posts 52 and 53 have been skewed or twisted helically about the center axis 26 to position the filament 51 substantially perpendicular to the plane 24.

Figure 2:
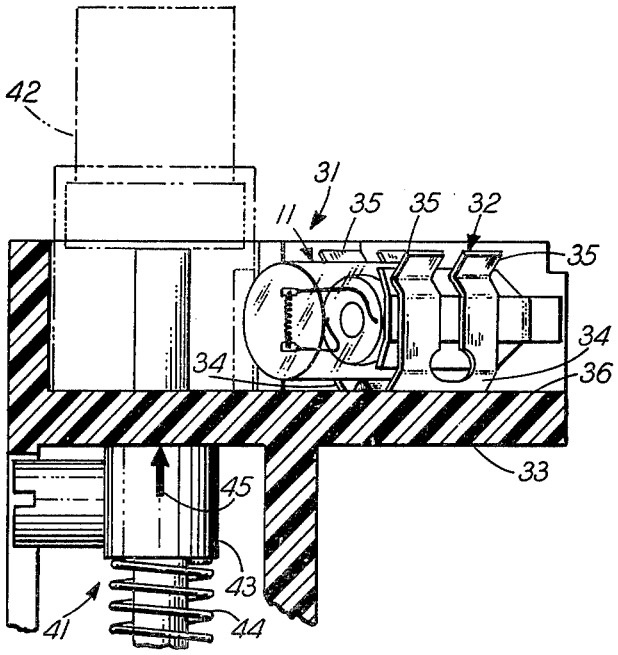
FIG. 2 is a side view of a portion of a key telephone as a typical apparatus wherein the switchboard lamp of FIG. 1 is advantageously used.

Referring to FIG. 2, the terminals 21 and 22 of the lamps 11 as inserted into the sockets 32 become positioned in a plane parallel to the top surface of the bracket 33. However, the plane parallel to the top surface of the insulator bracket 33 is coincident with the plane 24 through each of the lamps 11. The filament 51 in the lamp 11 is therefore positioned substantially collinear with or in substantially the same direction in which the shock is transmitted to the lamp 11. The arrow 45 indicates this general direction of the shock.

FIG. 2 shows a preferred embodiment of a key telephone to which the invention applies. In another key telephone (not shown) the pushbutton assembly 41 is slightly tilted with respect to the surface 36 of the bracket 33. Consequently, there is some deviation between the direction in which the filament 51 entends and the precise direction of the shock. This deviation, however, is small enough that the lamp 11 described herein can also be used for an extended lamp life. A requirement to achieve an advantage of the present invention is to have a major component of the shock transmitted to the lamp 11 directed the same as the filament 51.

Consequently, the effect of the orientation of the posts 52 and 53 and the filament 51 resulting in a lifetime of the lamp 11 within requirements depends on the environment in which the lamp 11 is used. It is believed for instance that the orientation of the filament in the direction of the shock reduces shock induced shear forces on the filament 51. The coiling of the tungsten wire (preferably with an inside diameter of approximately 4.5 milli-inch) is also believed to contribute to isolate the shock, provided the longitudinal axis of the coil extends in the direction of the shock. The wire of the filament 51 itself is a tungsten-rhenium wire specified by its cold state resistance of 29.8 ohms per inch, which is the same specification as that for a prior art filament.

A particular advantage was derived from the present embodiment, which indirectly contributes to further extend the lifetime of the lamp 11. The positon of the filament 51 substantially diametrically across the circular lens opening 19 improves the light efficiency of the lamp 11. To explain further, the light output of the lamp 11 through the lens opening 19 was found to have increased relative to the light output of a similar lamp with the same electrical rating but in which the filament was supported by an intermediate support. The intermediate support of the prior art lamp locates the filament in a U-shape away from the center of its lens. Also, the intermediate support is believed to act as a heat sink. These circumstances combine to reduce the light effectiveness of the prior art lamp with an intermediate filament support. The described embodiment alleviates these disadvantages for an improved light effectiveness of the lamp 11.

Changes and modifications may, of course, be made to the described embodiment without affecting the scope and spirit of the present invention. For instance, the precise shape of the posts 52 and 53 within the envelope does not appear to effect the life of the filament 51 as long as the position of the filament substantially in the same direction as the applied shock is retained.

What is claimed is:

1. An incandescent lamp comprising:

an envelope having a substantially cylindrical center portion, a base at one end of the center portion and a lens at the other end thereof;

a pair of terminals, each terminal having a contact surface located opposite the other on the outer surface of the center portion, adjacent the base and centered on a plane including the cylindrical axis of the center portion;

a pair of posts spaced from each other and mounted in the base, each post being adjacent one of the terminals, each of the posts being electrically coupled to its adjacent terminal, the posts extending within the envelope from the base toward the lens, the posts being skewed with respect to the cylindrical axis; and a filament spanning a gap between the two posts in a direction substantially perpendicular to the plane on which the terminals are centered, whereby a mechanical shock applied to the lamp in a direction substantially perpendicular to the plane is received by the filament in a direction coinciding generally with its longitudinal extent.

2. An incandescent lamp according to claim 1, wherein the filament is a helically wound resistance wire located adjacent to the lens and extending diametrically across its area.

3. An incandescent lamp having a filament protected against mechanical shock directed substantially perpendicular to a longitudinal plane on which terminals of the lamp are centered, the lamp comprising:

an envelope having a substantially cylindrical center portion, a base at one end of the center portion and a lens at the other end thereof;

a pair of terminals, the terminals extending from the base on diametrically opposite sides of the center portion of the envelope toward the lens to be centered on the longitudinal plane;

a pair of posts, each post mounted in the base adjacent one of the terminals, each post protruding at one end from the envelope substantially in the longitudinal plane on which the terminals are centered to be electrically coupled to the adjacent one of the terminals, each post extending in spaced relationship to the other from such protruding end with a twist along its length to terminate within the envelope adjacent the lens and at a point mutually opposite from and removed from the longitudinal plane on which the terminals are centered; and the filament mounted to extend between the posts in a direction substantially perpendicular to the terminals, whereby the shock applied to the lamp in its working environment is transmitted to the filament in a direction substantially collinear to its longitudinal extent between the posts.

4. An incandescent lamp comprising:

an envelope including a base;

a pair of terminals, each terminal having a contact surface located opposite the other on the outer surface of the envelope;

a pair of posts spaced from each other and mounted in the base, each post being adjacent one of the terminals, electrically coupled to such adjacent terminal, and extending within the envelope away from the base, the posts being skewed about a centerline through the envelope; and a filament mounted to the two posts to extend between the posts in a direction from which a mechanical shock is expected to be applied to the lamp upon the lamp being mounted in its intended operating environment.

* * * * *